United States Patent [19]

Bulso, Jr. et al.

[11] Patent Number: 4,587,825

[45] Date of Patent: May 13, 1986

[54] SHELL REFORMING METHOD AND APPARATUS

[75] Inventors: Joseph D. Bulso, Jr., Canton; James A. McClung, North Canton, both of Ohio

[73] Assignee: Redicon Corporation, Canton, Ohio

[21] Appl. No.: 605,920

[22] Filed: May 1, 1984

[51] Int. Cl.[4] ..... B21D 22/00; B21D 28/02

[52] U.S. Cl. ..... 72/329; 72/336; 72/339; 72/347; 72/348; 72/350; 413/56

[58] Field of Search ..... 72/329, 336, 339, 347, 72/348, 349, 350, 351; 413/56

[56] References Cited

U.S. PATENT DOCUMENTS

| | | | |
|---|---|---|---|
| 3,312,098 | 4/1967 | Henrickson | 72/349 |
| 3,537,291 | 11/1970 | Hawkins | 72/336 |
| 3,695,084 | 10/1972 | Siemonsen et al. | 72/348 |
| 3,902,347 | 9/1975 | Ridgway et al. | 72/336 |
| 4,031,837 | 6/1977 | Jordan | 413/8 |
| 4,051,707 | 10/1977 | Valek et al. | 72/348 |
| 4,093,102 | 6/1978 | Kraska | 220/67 |
| 4,119,050 | 10/1978 | Klein | 413/13 |
| 4,183,445 | 1/1980 | LaCross | 220/273 |
| 4,192,244 | 3/1980 | Kelley et al. | 413/17 |
| 4,213,324 | 7/1980 | Kelley et al. | 72/405 |
| 4,215,795 | 8/1980 | Elser | 220/276 |
| 4,244,315 | 1/1981 | Klein | 413/17 |
| 4,291,567 | 9/1981 | Murayama | 72/247 |
| 4,305,523 | 12/1981 | Dalli et al. | 220/268 |
| 4,345,696 | 8/1982 | Guimarin | 220/277 |
| 4,348,464 | 9/1982 | Khoury | 428/571 |
| 4,414,836 | 11/1983 | Saunders | 72/348 X |

FOREIGN PATENT DOCUMENTS

| | | | |
|---|---|---|---|
| 0061756 | 10/1948 | Netherlands | 72/347 |

*Primary Examiner*—Francis S. Husar
*Assistant Examiner*—Steve Katz
*Attorney, Agent, or Firm*—Reese Taylor

[57] ABSTRACT

Method and apparatus for forming or reforming the shell of a two-piece container includes forming a cup shaped member in an upside down condition, reverse drawing the shell to form an over length chuckwall loosely holding the shell while pulling the excess material from the chuckwall into the bottom panel of the shell. The apparatus comprises tooling incorporated into a double acting press and including a punch core carried by the inner ram and an opposed die core carried by the bottom platen, a first pressure member carried by the outer ram and a die core ring fluidly supported on the bottom platen opposed to the pressure member and a punch shell carried on the inner ram. A second fluid pressure sleeve means is carried on the bottom platen in opposed relationship to the punch shell and a knockout piston is also carried by the lower platen opposed to the punch core and encircling the die core. The tooling is arranged such that the first pressure sleeve holds the material against the die core ring under fluid pressure while the punch shell draws the material over the die core ring to preliminarily form the chuckwall. The second pressure sleeve is movable into engagement with the die core ring under pressure from the punch shell so that, as the punch core terminates its travel, holding pressure is reduced as the over length material is pulled into the central area of the end panel.

11 Claims, 12 Drawing Figures

SHELL REFORMING METHOD AND APPARATUS

RELATED PATENT APPLICATIONS

This application is related to copending application Ser. No. 605,888 filed May 1, 1984 by the same inventors and entitled Container End Panel Forming Method and Apparatus.

FIELD OF THE INVENTION

This invention relates, in general, to forming container end panels or "shells" for closing the ends of two-piece containers and relates, in particular, to an improved method and apparatus for forming a sharper radius in the chuckwall area so that thinner stock can be employed while achieving the same or even improved end buckle strength. The invention can be used to "reform" a partially formed shell by tightening up the chuckwall radius or to completely form the shell from flat metal stock.

DESCRIPTION OF THE PRIOR ART

Metal containers or cans are well known in the art with these containers primarily being employed for food and beverages but, of course, having utility for other products as well.

Currently, the most common containers of this general nature are of the "two-piece" variety, comprising a unitary container body and a container end panel or "shell" which is ultimately affixed to the open end of the can after the contents have been supplied. Both components are commonly drawn and redrawn from flat metal stock to their final configuration.

Various end panels and conventional methods and apparatus for their forming can be seen in many U.S. Patents, such as, Khoury U.S. Pat. No. 4,348,464; Guimarin U.S. Pat. No. 4,345,696; Dalli et al U.S. Pat. No. 4,305,523; Murayama U.S. Pat. No. 4,291,567; Klein U.S. Pat. No. 4,244,315; Elser U.S. Pat. No. 4,215,795; Kelley et al U.S. Pat. No. 4,213,324; Kelley et al U.S. Pat. No. 4,192,244; LaCross U.S. Pat. No. 4,183,445; Klein U.S. Pat. No. 4,119,050; Kraska U.S. Pat. No. 4,093,102; and Jordan U.S. Pat. No. 4,031,837. This art is representative of various approaches to shell forming.

As a general principle, it should be noted that the contents of containers thus formed are often packed under pressure. For example, a typical beverage container must withstand pressures on the order of 90 p.s.i. without buckling with buckling being defined as pulling at least a portion of the chuckwall upwardly and inwardly away from its connection with the container body. In order to provide a safe and effective container, the thinnest portions of the two pieces of the container, i.e., of the body and the shell, must be of sufficient strength and thickness to withstand the maximum internal pressure of the contents.

Heretofore, the primary source of difficulty in this regard has been with the container shell, which is formed with various contours so that it may be sealed to the top of the cylindrical body by a curling process. The contours of the shell include various radiused areas. Generally, difficulties have been encountered because of the fact that, during the drawing operation, these radiused areas tend to thin out as the metal is drawn or stretched.

In most of the prior art, it has been found necessary to compensate for this phenomenon by utilizing a heavier gauge metal than would otherwise be required to provide sufficient thickness in the finished product in the radiused areas to withstand the above mentioned internal pressures.

Stated otherwise, because of the fact that the radiused areas normally tend to thin out to a greater degree than the flat portions of the end panel, the result is that these portions of the final shell are generally thicker than required. In effect, this is an over compensation which results in the waste of material. This is a serious drawback because of the fact that, routinely, containers of this type are produced in large volume operations and it will be appreciated that any metal saving, multiplied by the total number of containers, will result in significant cost savings.

It has been discovered that some of these difficulties can be overcome by providing apparatus and a method of operating the apparatus in which the starting stock thickness can be significantly reduced without sacrificing the strength of the shell.

SUMMARY OF THE INVENTION

It is, therefore, a primary object of this invention to produce a method and an apparatus for forming shells wherein the contours are formed with radiuses as small as desired without affecting the buckle strength of the finished product and without the necessity of increasing the thickness of the starting material to compensate for thinning during the forming operation.

It has been discovered that this object can be achieved by providing apparatus which overdraws the length of the chuckwall and then permits some of the material in the over drawn area to be subsequently pulled into the center panel of the shell. It has been discovered that utilization of apparatus and forming method of this type permits extremely tight radiuses to be formed without the usual difficulties such as fracturing which normally occur when a very sharp radius is formed. The fracturing and shearing normally encountered when a very tight radius is attempted are well known in the art and lead to the over compensation referred to above.

Accordingly, production of an improved method and apparatus for forming shells for containers having the above noted characteristics becomes the principal object of this invention with other objects thereof becoming more apparent upon a reading of the following brief specification considered and interpreted in view of the accompanying drawings.

OF THE DRAWINGS

BRIEF DESCRIPTION OF THE PREFERRED EMBODIMENTS

Figure 1:
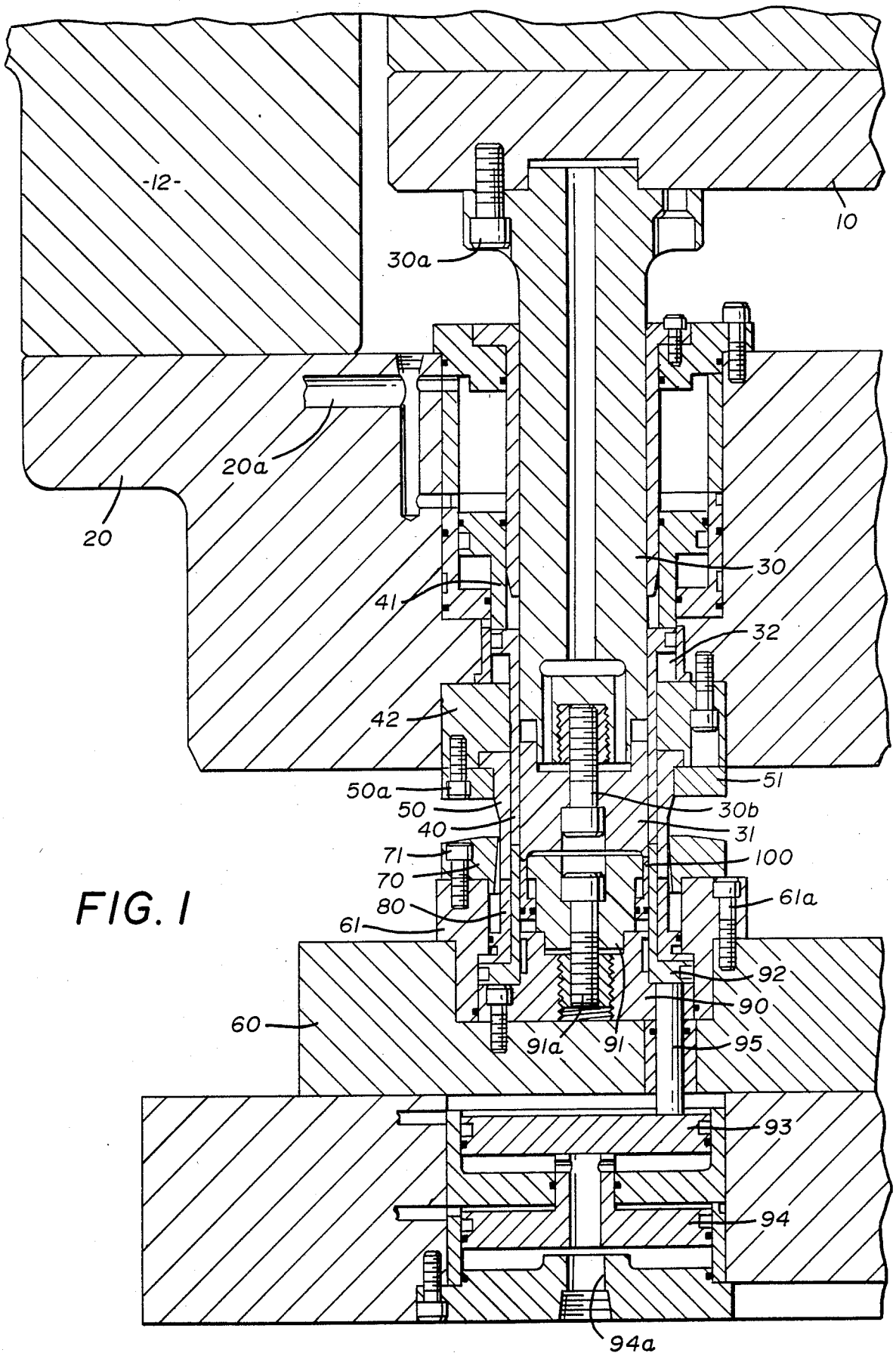
FIG. 1 is an elevational view, in section, showing the tooling in the bottom, dead center position with respect to both rams.

As noted above, the tooling and apparatus of the present invention is intended to be utilized in a double action press and, to that end, FIG. 1 of the drawings illustrates an inner ram 10 and an outer ram 12. The press has not been described in great detail since such presses, as exemplified in Ridgway U.S. Pat. No. 3,902,347, are well known in this art. Suffice it to say, however, that presses of the double acting type make it possible to accurately control operation of the tooling carried thereon in various ways during a given press cycle.

Figure 4:
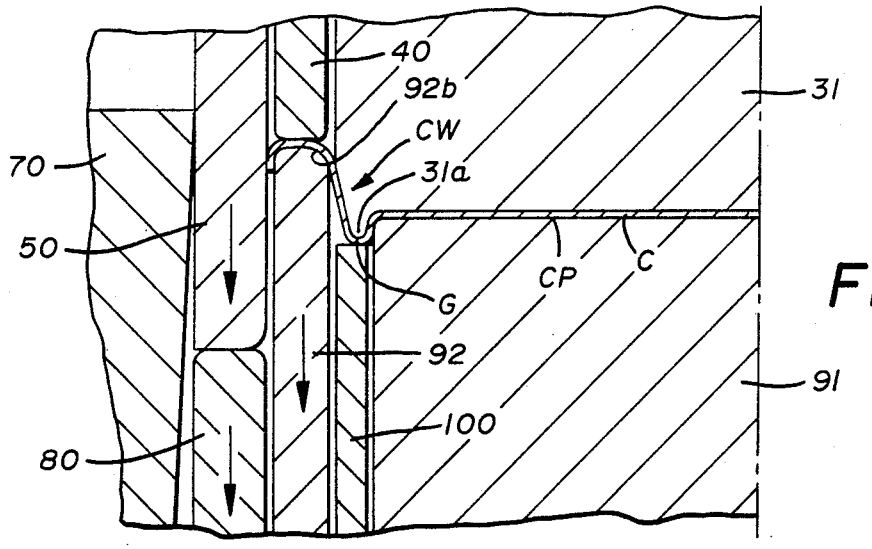

Still referring then to FIG. 1 of the drawings for a description of the apparatus, it will first be noted that FIG. 1 illustrates the tooling in the bottom, dead center position, somewhat similar to the position of the components illustrated in FIG. 4 of the drawings.

Still referring then to FIG. 1, it will be noted that the inner ram 10 carries with it a punch center post 30 which is secured to the inner ram for movement therewith by a plurality of screws 30*a* (only one shown). Attached to the distal end of the punch center post 30 by screw 30*b* is a punch core 31 which is spaced from the post by the usual punch core spacer 32.

The outer punch holder 20 carried by outer ram 12 carries a pressure sleeve system including a pressure sleeve 40 and a piston 41. These are operated by pneumatic or hydraulic pressure supplied through the bore 20*a* of punch holder 20 from a suitable source (not shown). No great detail has been shown here except that it should be understood that sufficient pressure can be exerted through the bore 20*a* to activate the piston 41 so that it bears on the pressure sleeve 40 and forces it toward the bottom platen 60 for purposes which will be described.

The outer punch holder 20 also carries a pressure sleeve retainer 42 and a punch shell 50 which is held on the punch holder by clamp ring 51 by suitable screws 50*a*.

The bottom platen 60, still referring to FIG. 1, carries, on its top edge, a support ring 61 held onto the platen 60 by a plurality of screws 61*a*. Mounted on top of the support ring 61 is a blank cut edge 70 which is, in turn, held in place by a plurality of screws 71.

Received internally of the support ring 61 and the cut edge 70 is a second pressure member or sleeve 80 which is normally urged to the up position or toward the top of the press by suitable fluid pressure, such as hydraulic or pneumatic. Of course, since FIG. 1 illustrates the tooling in the bottom dead center position, sleeve 80 is shown in a "down" position.

Received still further internally and concentrically inwardly of the pressure sleeve 80 is the die core ring 92 which, likewise, is urged normally, upwardly by fluid pressure as will be described in greater detail below. In this regard, air is the preferred medium although other fluids could be employed.

Still further inwardly and concentrically mounted is a knockout member 100 which is also fluid actuated and still further inwardly is a die core riser 90 and a die core 91 fixed thereto by screw 91*a*. The members 90 and 91 are fixed to the bottom platen 60 and do not move during operation.

Still referring to FIG. 1 and referring particularly to die core ring 92, it will be noted that the ring rests on a piston rod 95 which, in turn, is supported by a first support piston 93 and a second support piston 94. These members are normally urged in the upward direction by fluid pressure through bore 94*a* until overcome by greater forces moving in a downward direction as will be described in connection with the operation of the apparatus.

Figure 2:
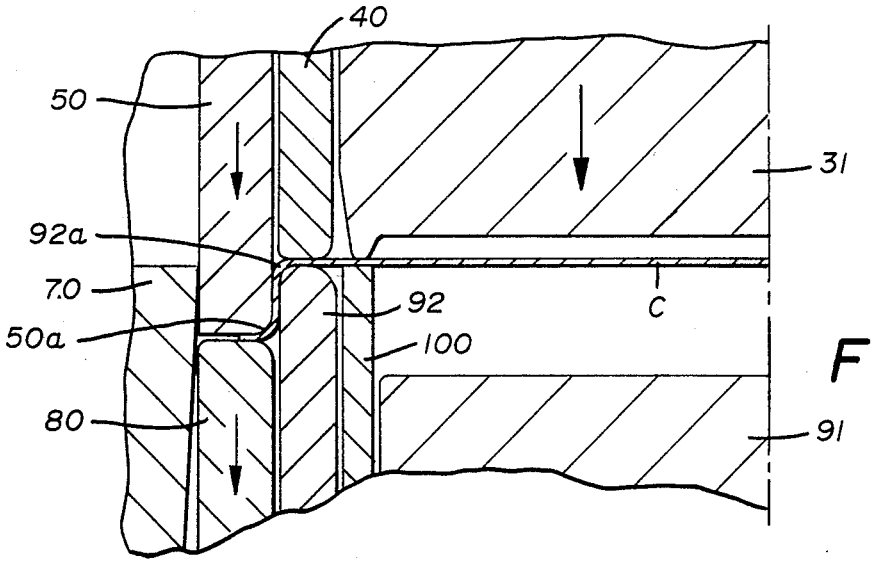
FIGS. 2 through 9 are partially schematic elevational views showing the various positions of the tooling during the forming and reforming operations.

Turning then to FIGS. 2 through 9 for a description of the operation of the apparatus and tooling of the present invention illustrated in FIG. 1, it will first be assumed that, as illustrated in FIG. 2, the blanking operation has been completed by downward movement of punch shell 50 in cooperation with the blank cut edge 70.

FIG. 2 illustrates the formation of a reverse cup C following the blanking operation. In this figure, the punch core 31 and the punch shell 50 are moved downwardly as indicated by the arrows in the drawing and as shown by the timing diagram of FIG. 12. At this point, the first pressure sleeve 40, under pressure applied through bore 20*a* on piston 41, will be holding the metal against the die core ring 92 which is supported by pistons 93 and 94. Downward movement of the punch shell 50 will pull the material over the radius 92*a* of the die core ring 92 and radius 50*a* of punch shell 50 with it being understood that the peripheral edge is held between punch shell 50 and and second pressure sleeve 80. This will result in formation of the "reverse" cup C illustrated in FIG. 2.

Figure 3:
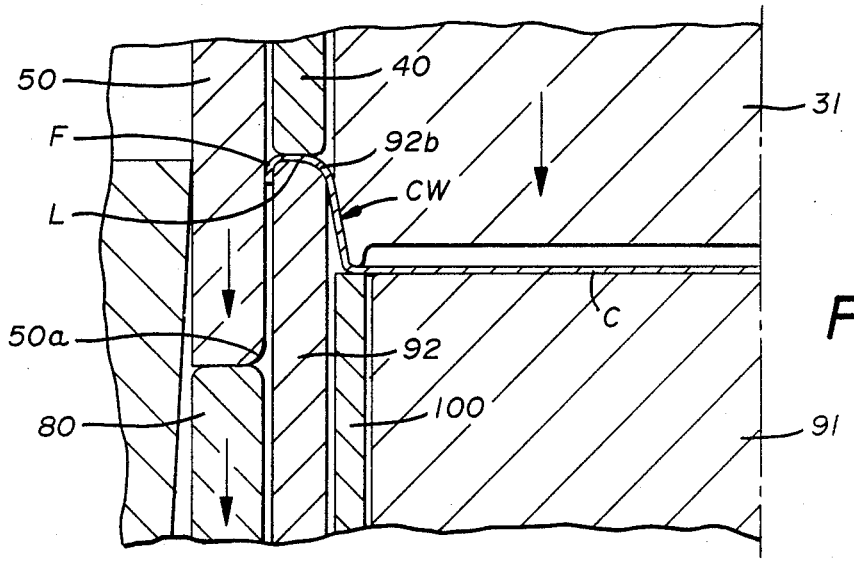

In FIG. 3, punch core 31 continues its downward movement drawing the lip L and establishing the chuckwall area CW. The punch shell 50, it will be noted, continues downwardly forcing second pressure sleeve 80 in a downward direction setting the lip height of the seaming panel. Also, knockout member 100 is forced down by the punch core 31. Die core ring 92 is nearly bottomed at this point since the pressure from pistons 93 and 94 has been overcome and the flange F is really drawn around radius 92*b* to form the chuckwall. It should be noted that the chuckwall CW is "over length" at this point for purposes which will be described below. In effect, the shell or end panel is overdrawn at this point.

Turning to FIG. 4 then, it will be seen that the punch shell 50 and second pressure sleeve 80 are still moving in a downward direction, as is the die core ring 92. In that regard and referring to FIG. 1, it will be noted that the die core ring 92 and the second pressure sleeve 80 are mechanically engaged at this point. Therefore, when the punch shell 50 forces the second pressure sleeve 80 in a downward direction, the sleeve 80 will take with it the die core ring 92 while first pressure sleeve 40 merely follows. This results in little or no holding pressure or tension on the metal between die core ring 92 and first pressure sleeve 40 so that the material in chuckwall CW can be pulled around radius 92*b* to form the end panel. As can be seen, profile pad 91 is actually pushing up against the material which puts the excess material from the chuck wall area CW into the center panel CP.

This avoids the problem often encountered with a conventional draw around a sharp radius with firm holding pressure. This occurs as the punch core 31 is moving toward the bottom dead center position and is close to bottoming out. Effectively at this point then, the length of the chuckwall CW is shortened to its final dimension and the material which is pulled, as noted, around the radius 92*b* of die core ring 92 and radius 31*a* on the punch core 31, actually forms the central panel CP of the shell and sets the annular reinforcement groove G.

It should be noted here that punch core 31 never truly bottoms out on die core 91. Thus, if a double shell is encountered as sometimes happens, the tooling will be protected from damage.

Figure 5:
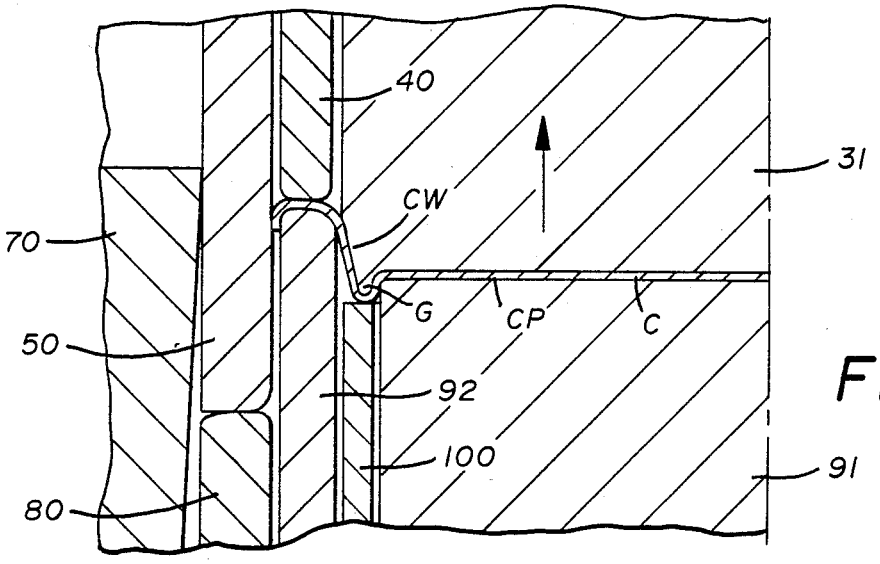
Figure 12:
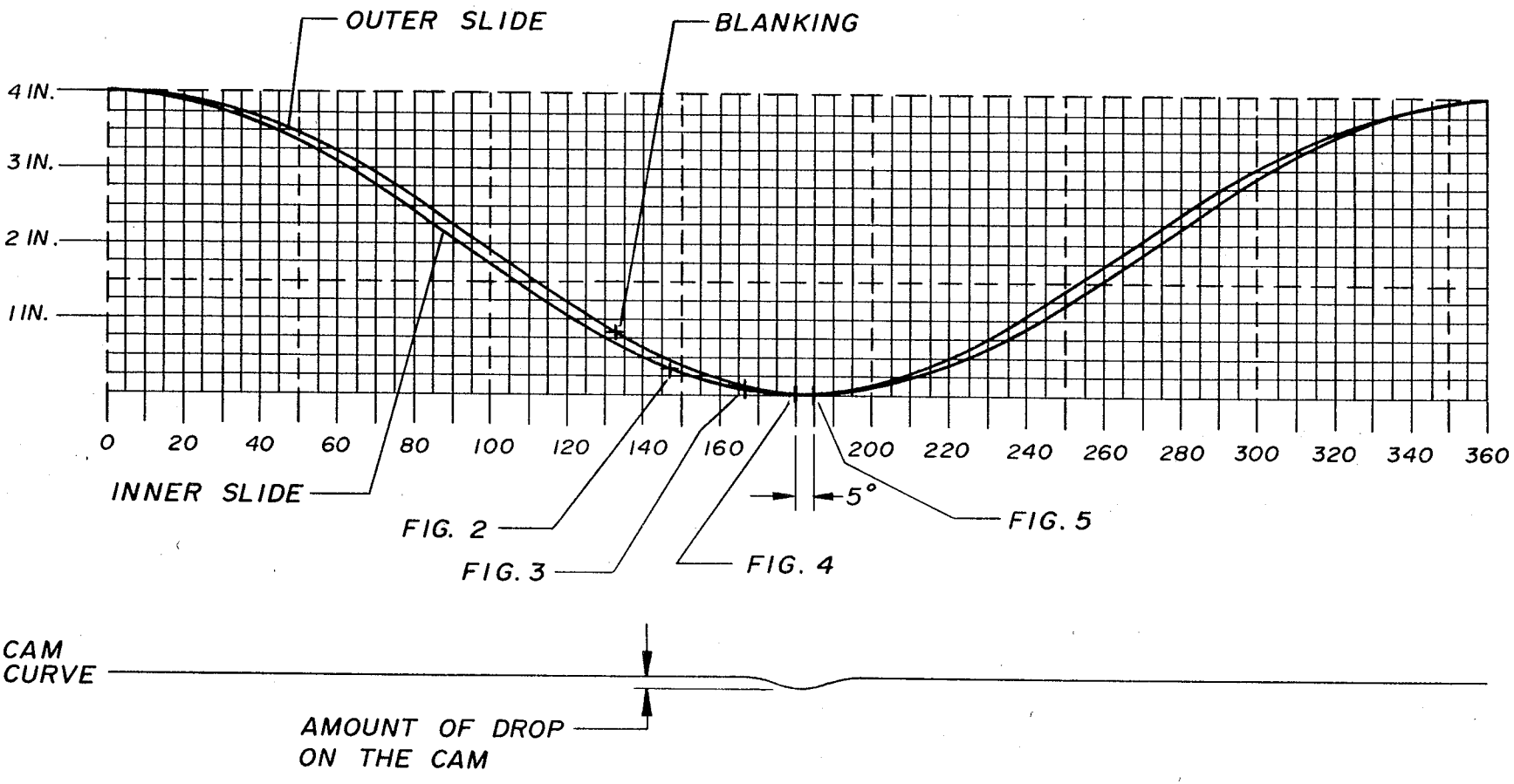
FIG. 12 is a timing diagram.

Referring to FIG. 5, it will be noted that the punch shell 50 and the second pressure sleeve 80 are, in this figure of the drawings, at bottom dead center while the punch core 31 has started its upward movement along with inner ram 10 (see FIG. 12).

Figure 6:
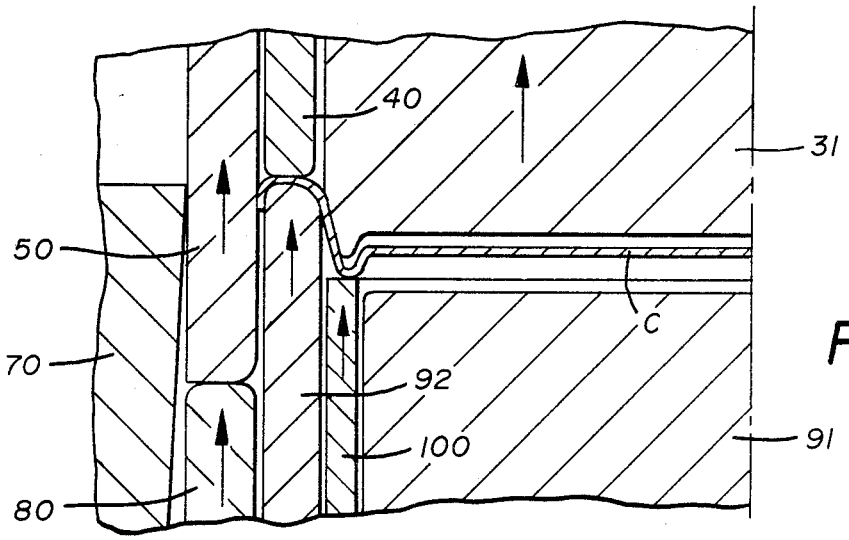

FIG. 6 illustrates the position of the tooling when the outer punch holder 20 has started up and it will be noted that retraction of the punch core 31 has begun. Also, the second pressure sleeve 80 and punch shell 50, have started up since the sleeve is no longer being held down by punch shell 50. At the same time, the knockout ring 100 also has started its upward movement under fluid pressure since it is no longer held down by punch core 31.

Figure 7:
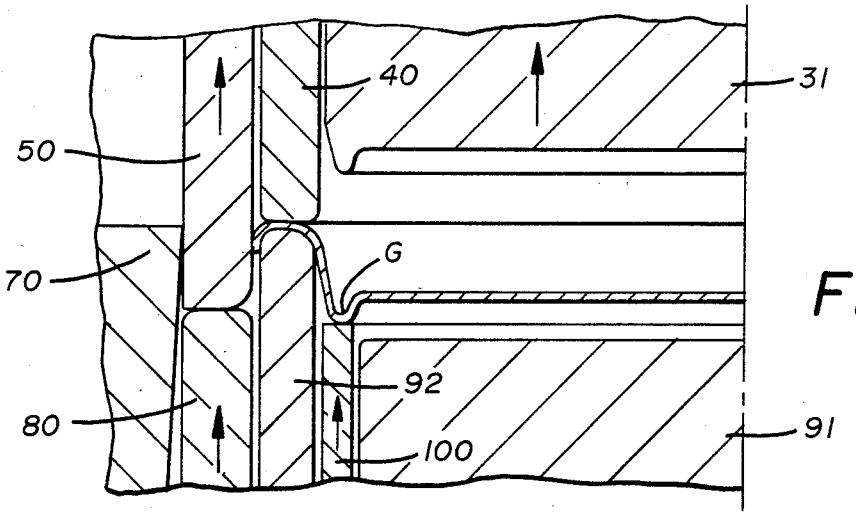
Figure 8:
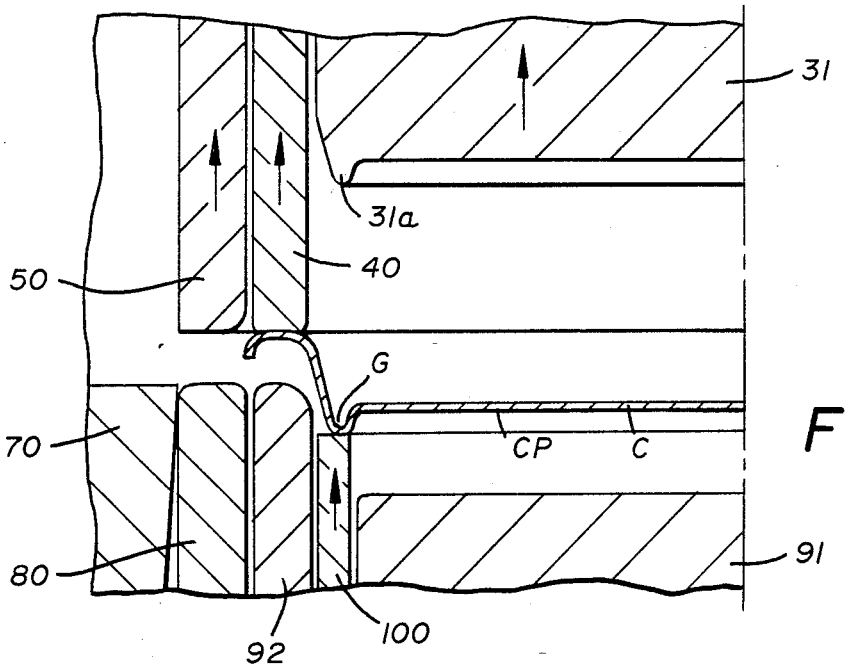

FIGS. 7 and 8 show further progression of the upward movement with it being understood that at this point both the inner rams and their associated punch holders are continuing to move upwardly with the knockout ring 100 also continuing in an upward direction, as illustrated by the arrows in the drawings.

Figure 9:
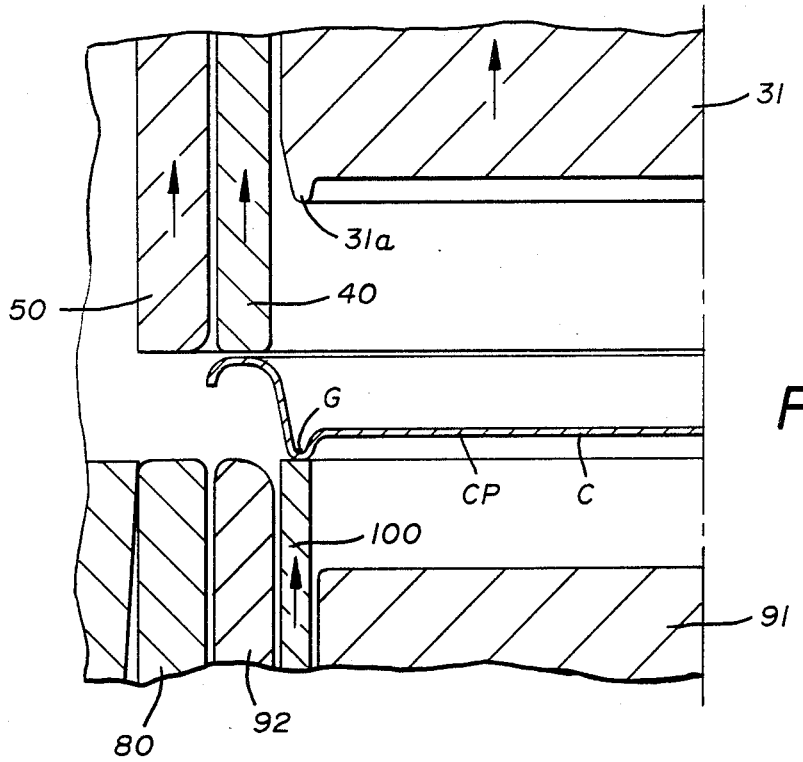

FIG. 9 shows the complete open position of the tooling with the punch core 31 and the first pressure sleeve 40 and punch shell 50 being lifted completely out of the way, sufficient, at least, for the shell C to be lifted above the die line by the knockout ring 100 for removal from the press or transfer to the next station.

It should be apparent from the foregoing that the height of the lip L is set initially at the stage of the operation illustrated in FIG. 3 and does not change and is not disturbed during the subsequent operations. It is important to note, however, as already mentioned, that the length of the chuckwall CW initially set in FIG. 3 is slightly longer than its final dimension. This makes it possible to accumulate additional material in that area and, as already noted, that material is actually pulled down into the center panel CP to form that panel. The result, however, is that the final thickness in the chuckwall area is maintained to the desired specifications and is not, in fact, thinned out as would be the case if that area were subject to a drawing operation at that point.

It should also be noted that this type of operation avoids coining of the lip L. By pulling rather than drawing the material in the chuckwall area, it is possible to apply much lighter pressure on the lip L at the critical stage. This avoids any marking or coining of the lip which is important because if the lip is coined or marked, it is subject to cracking during the subsequent seaming operation.

It will also be apparent that the radius of the annular groove G can be as tight as desired. While there is some limit as to how tight a radius can be achieved in a drawing operation, there is virtually no limitation on the sharpness of the radius in this area with a shell formed in this fashion. As a matter of fact, the radius could be so severe that the opposite sides of the metal which form the groove G could be in metal to metal contact if desired and required for the particular application intended for the shell thus formed.

Figure 10:
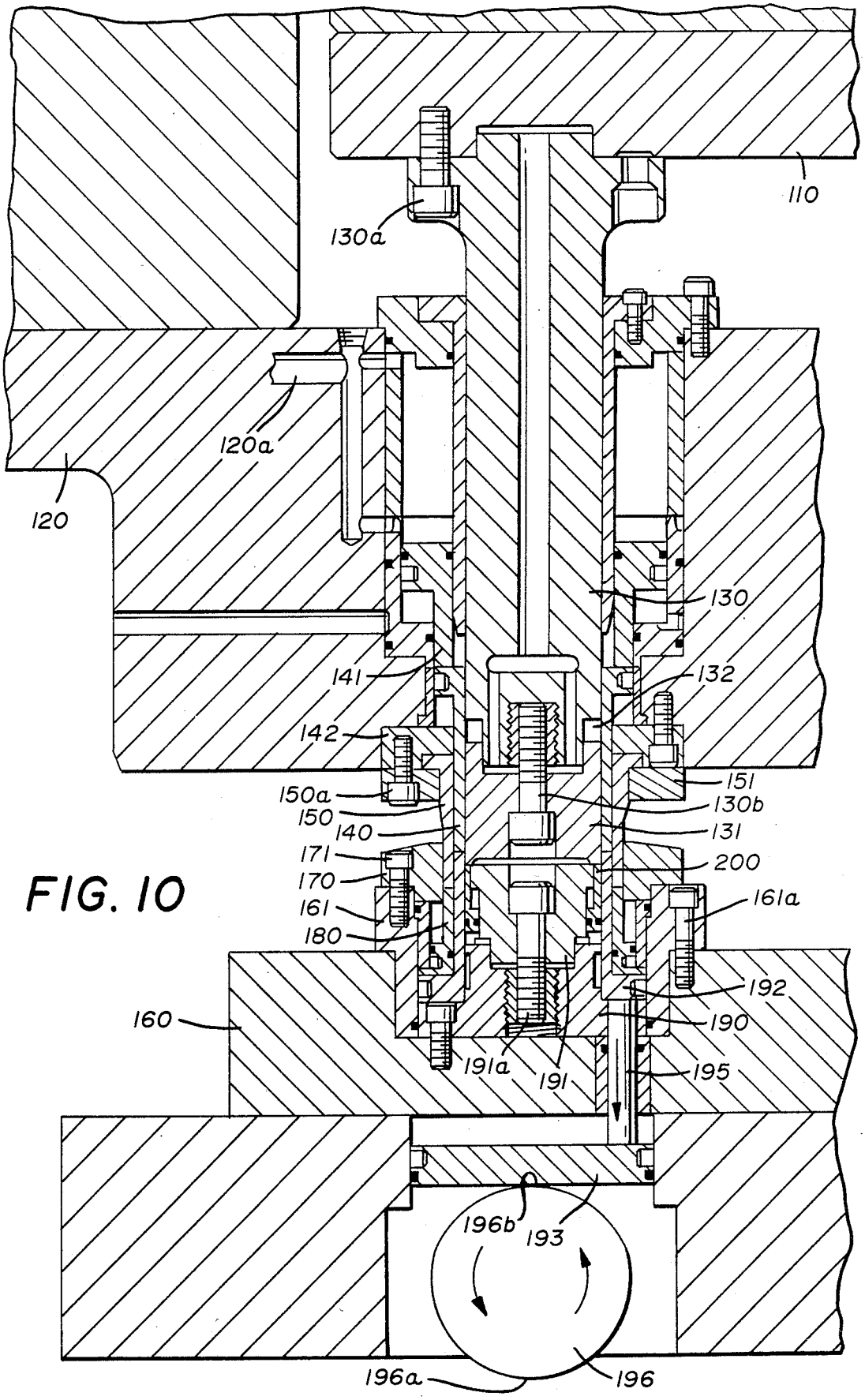
FIG. 10 is an elevational view, in section, showing a modified form of the invention with the tooling in the bottom, dead center position with respect to both rams.
Figure 11:
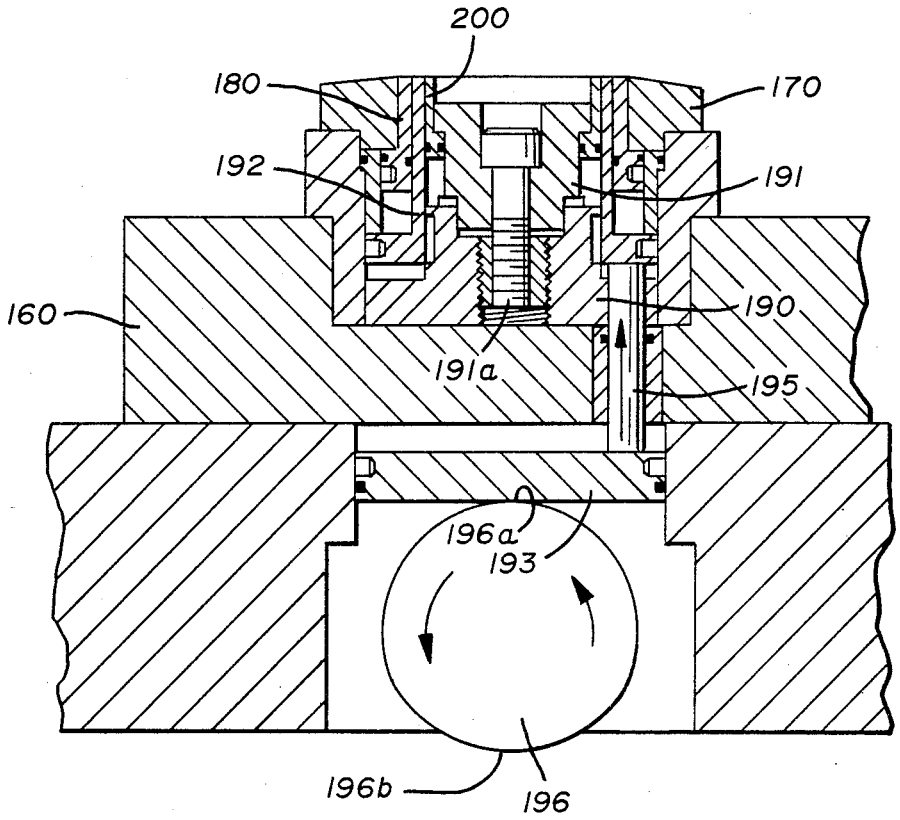
FIG. 11 is a partial elevational view of the modification of FIG. 10 following forming of the end panel and after lift off of the inner ram.

Referring to FIGS. 10 and 11 of the drawings wherein a modified form of the invention is illustrated, it will be noted that the basic components of the structure are identical except for the apparatus for controlling the die core ring and that similar numbers have been employed in the 100 series except where the tooling varies.

Thus, it will be seen that an inner ram 110 carries a punch center post 130, a punch core spacer 132, and a punch core 131.

The outer punch holder 120 carries the pressure sleeve 140 and pressure sleeve piston 141. It also carries the pressure sleeve retainer 142, the punch shell clamp 151, and the punch shell 150.

The bottom platen 160 carries the cut edge 170, the second pressure sleeve 180, and the die core ring 192 and knockout member 200.

In FIG. 1, die core ring 92 is supported by rod 92 which is, in turn, supported by fluid operated pistons 93 and 94. In this form of the invention, however, rather than supporting the die core ring 192 and the piston rod 195 and piston by fluid pressure, the piston 193 is supported by the cam 196. Again the function of the cam 196, similar to that of the fluid pressure of the form of the invention of FIGS. 1 through 9, will be to normally urge the die core ring to the up position when the full diameter area **196*a* is in contact with piston 193. As the cam rotates, however, and as the cam passes through its path of rotation and reduced diameter area 196*b* comes into contact, the piston 193, the rod 195, and the die core ring 192 are permitted to drop down. This is timed so as to coincide with the downward movement of the pressure sleeve 140 and, again, during this phase of the operation of the apparatus (see FIG. 4**), little or no holding pressure is being applied to the metal, thereby permitting that metal to be pulled around the very tight radius, permitting at least a portion of the metal in the overlength chuckwall area to be pulled into the center portion of the shell.

The stages of operation illustrated in FIGS. 2 through 9 are followed in the modification of FIGS. 10 and 11 with the essential difference being the substitution of the cam 196 for the fluid pressure as a means for supporting the die core ring.

While a full and complete description has been set forth in accordance with the dictates of the Patent Statutes, it should be understood that modifications can be resorted to without departing from the spirit hereof or the scope of the appended claims.

What is claimed is:

1. A method of forming a container end panel having a peripheral flange from a flat sheet of material comprising the steps of:

(a) blanking and drawing a reverse cup while holding the peripheral edge of the material under pressure;

(b) drawing the lip of the end panel and establishing an over length chuckwall; and (c) releasing holding pressure on the peripheral edge and pulling metal from the chuckwall into the central panel of the end panel while simultaneously setting the chuckwall radius and reducing the length thereof.

2. The method of claim 1 wherein said holding pressure is supplied by fluid actuated pressure means in cooperation with an opposed die core ring; said die core ring and said pressure means moving together during step c to relieve holding pressure.

3. The method of claim 2 wherein said die core ring is normally urged toward said pressure means by fluid pressure.

4. The method of claim 2 wherein said die core ring is normally urged toward said pressure means by a cam actuated assembly.

5. Apparatus for forming a container end panel in a double acting press having movable inner and outer rams and a fixed platen, comprising:

(a) a punch core carried by the inner ram and die core carried by the fixed platen arranged in opposed relationship to said punch core;

(b) first pressure means carried by the outer ram and a die core ring carried by the fixed platen arranged in opposed relationship to said first pressure means;

(c) said first pressure means normally holding the end panel against said die core ring; and (d) said first pressure means moved by said outer ram into engagement with said die core ring whereby continued movement of said outer ram causes said first pressure means and said die core ring to move together relatively of said fixed die core to reduce holding pressure on said end panel.

6. The apparatus of claim 5 wherein said die core ring is normally urged toward said first pressure means; a punch shell is carried by the outer ram in opposed relationship with a second pressure sleeve; said second pressure sleeve engaging said die core ring in response to travel of said punch shell to move said die core ring together with said first pressure means.

7. The apparatus of claim 6 wherein said die core ring is normally urged toward said first pressure means by fluid pressure.

8. The apparatus of claim 6 wherein said die core ring is normally urged toward said first pressure means by a cam actuated assembly.

9. Apparatus for forming the end panel of a container, in a double acting press having movable inner and outer rams and a fixed platen, from a flat sheet of material, comprising:

(a) a punch core carried on the inner ram;

(b) a fixed die core carried on the platen in opposed relationship to said punch core;

(c) a first pressure sleeve system carried on the outer ram;

(d) a die core ring supported on the platen in opposed relationship to said pressure sleeve system;

(e) a punch shell carried on the inner ram;

(f) second pressure sleeve means carried on the platen in opposed relationship to said punch shell;

(g) a fluid operated knockout piston carried by the platen in opposed relationship to said punch core and in encircling relationship with said die core;

(h) said first pressure sleeve system holding said material against said die core ring under fluid pressure;

(i) said punch shell drawing the material over said die core ring to form a reverse cup and forcing said second pressure sleeve downward into mechanical engagement with said die core ring upon movement of the outer ram toward the platen;

(j) said punch core forcing said knockout piston downwardly upon movement of the inner ram toward the platen and drawing the material over the draw core ring to form an overlength chuckwall in the end panel; and (k) said second pressure sleeve means, said first pressure sleeve system, and said die core ring movable downwardly in unison relatively of said fixed die core as said punch core approaches its extended position to shorten the chuckwall and force metal into the central portion of the end panel.

10. The apparatus of claim 9 wherein said die core ring is normally urged toward said first pressure sleeve system under fluid pressure.

11. The apparatus of claim 9 wherein said die core ring is normally urged toward said first pressure sleeve system by a cam actuated assembly.

* * * * *